United States Patent [19]

Robinson

[11] 4,192,221

[45] Mar. 11, 1980

[54] RADIAL PISTON ENGINE

[76] Inventor: Thomas C. Robinson, 100 Hill Rd., Berkeley, Calif. 94708

[21] Appl. No.: 974,567

[22] Filed: Dec. 29, 1978

[51] Int. Cl.[2] ..... F01B 1/06

[52] U.S. Cl. ..... 91/487; 91/495; 60/456; 60/484

[58] Field of Search ..... 91/487, 486, 491, 495, 91/498; 418/83, 85, 161; 60/374, 484, 486, 456

[56] References Cited

U.S. PATENT DOCUMENTS

| | | | |
|---|---|---|---|
| 3,691,909 | 9/1972 | Eickmann | 91/487 |
| 3,858,486 | 1/1975 | Eickmann | 91/487 |
| 3,942,414 | 3/1976 | Eddy | 91/487 |

*Primary Examiner*—Edgar W. Geoghegan
*Attorney, Agent, or Firm*—Lothrop & West

[57] ABSTRACT

The engine comprises a base having a spool fastened thereon, the spool including a hub symmetrical about a first axis and having a pair of side plates normal to and having inside faces spaced apart along the first axis. There are plate ports in the inside faces. A cylinder rotor includes a second hub rotatable on the first hub about the first axis and includes a pair of side discs normal to the first axis and having outside faces spaced apart axially between said side plates to establish first and second axial clearances between the side plates and the adjacent side discs. There are cylinders mounted radially on the cylinder rotor with ducts extending from the cylinders to the disc ports in the outside faces radially opposite the plate ports. A driven shaft symmetrical about a second axis is eccentrically journalled in and extends through the hub. A rotor is fast on the driven shaft and carries pivot pins. There are pistons in the radial cylinders and connecting rods pivoted in the pistons and pivoted on the pivot pins. On the rotor are some spacing pins carrying eccentrics. Eccentric strap bearings extend around the eccentrics and are secured to the spool. There are separate, constant volume oil pumps appropriately driven, each being connected to a respective one of the axial clearances in order to maintain the dimensions and shapes of the clearances such that gas leakage therethrough from the ports toward the atmosphere is maintained at a predetermined minimum value.

18 Claims, 12 Drawing Figures

4
5
69
68
80
77
78
76
61
67
64
73
74
63
66
18
86
79
87
43
88
28
30
42
70
27
19
82
72
41
82'

FIG-4
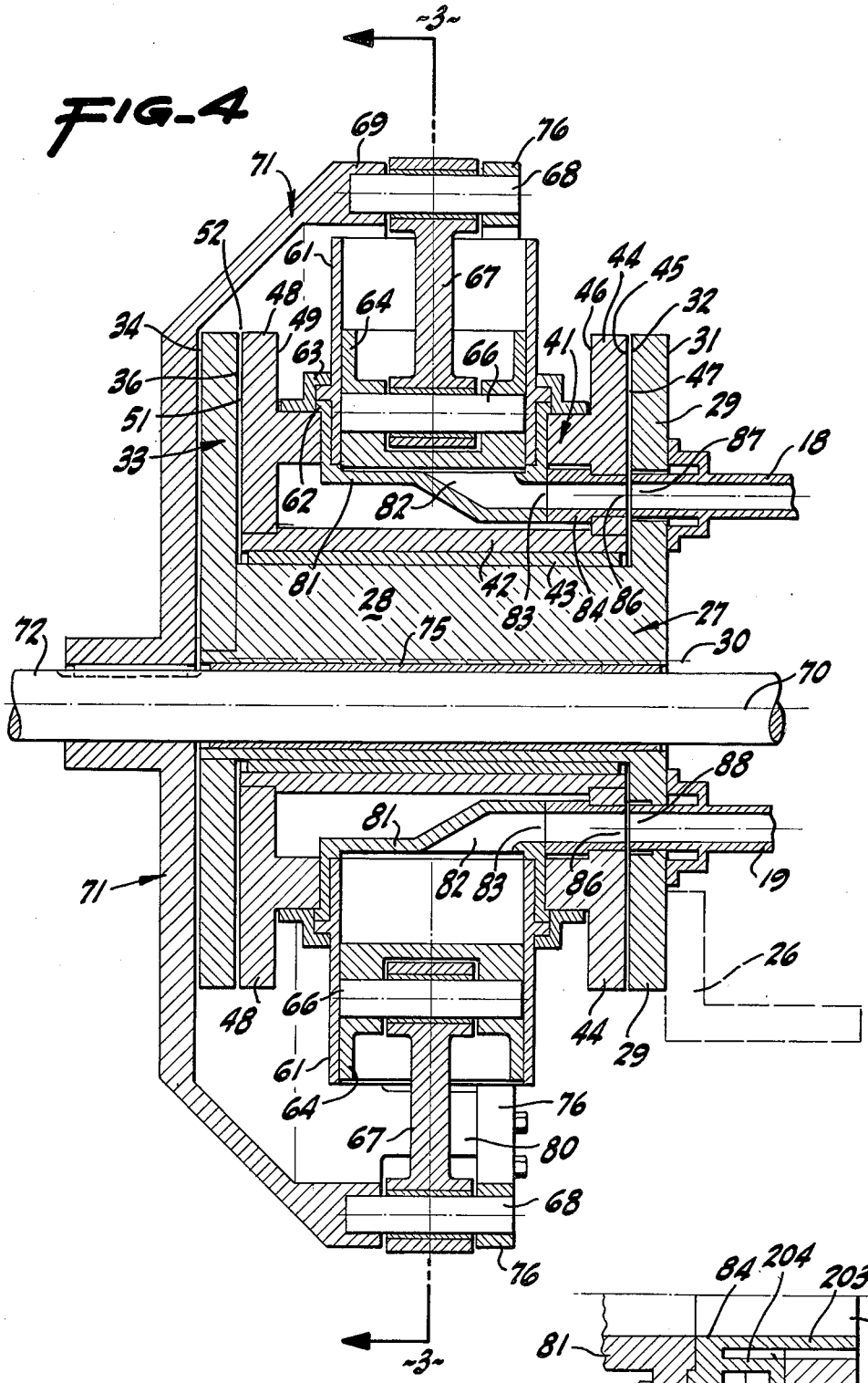
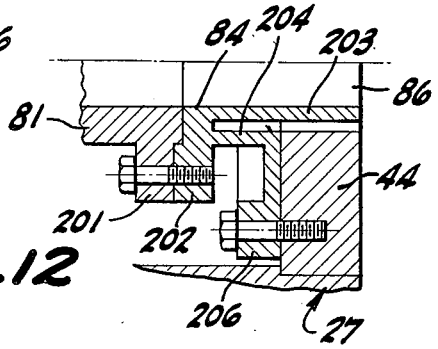
FIG-12

PUMP #1
PUMP #2
PUMP #3
PRESSURE EQUALIZER
SUMP-123

RADIAL PISTON ENGINE

BRIEF SUMMARY OF THE INVENTION

Disclosed is an engine operating in a circuit according to the Brayton cycle, the engine itself being generally a radial reciprocator and taking in high temperature, high pressure gas to the individual cylinders when their respective pistons are adjacent the minimum dead-center position and with the gas passing from a stationary part of the engine and going past a limited leakage space to the cylinders. The dimensions axially of the leakage space are governed by oil from separate, constant volume pumps. The absence of rubbing sealing means allows some gas leakage, but such leakage is maintained below a predetermined or selected value. The amount of leakage is inconsequential and does not adversely affect the efficiency of the engine except in a tolerable amount.

BRIEF DESCRIPTION OF THE SEVERAL VIEWS OF THE DRAWINGS

FIG. 4 is a cross-section, the planes of which are indicated by the broken line 4—4 of FIG. 3.

FIG. 12 is a port detail in cross-section.

In all of the foregoing figures, various portions are broken away or omitted to reduce the size of the figures.

DETAILED DESCRIPTION

The present engine is particularly constructed and arranged in a radial fashion and primarily for use in a working arrangement according to the Brayton cycle.

Figure 1:
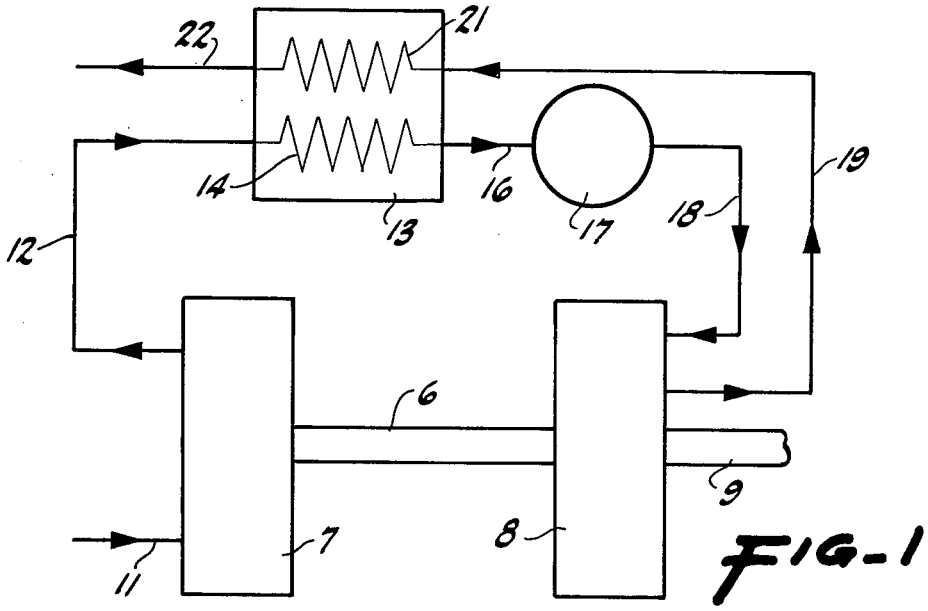
FIG. 1 is a diagram showing the present engine arranged in an appropriate circuit for operation on the Brayton cycle.

The general layout is diagrammatically disclosed in FIG. 1, in which there is arranged on one rotary shaft 6 an air compressor 7 and also the engine 8 embodying this invention. The shaft 6 is a power shaft, which not only receives power from the engine 8 for rotation of the compressor 7, but likewise has an output portion 9 for supplying surplus power exteriorly.

Atmospheric air either directly from the atmosphere or perhaps supercharged or precompressed is supplied to the compressor 7 through an inlet duct 11. After having its pressure raised substantially, the air is discharged at the higher pressure and at a corresponding higher temperature through a pipe 12 leading through a heat exchanger 13. Within the heat exchanger is a heat exchange surface 14 for conducting the compressed atmospheric air through the heat exchanger and subjecting it to heat to increase its raised temperature substantially.

The heated compressed air from the exchanger 13 is taken through a duct 16 into a combustion device 17 wherein an airfuel mixture is made and is burned and furnished to a pipe 18 leading to the engine 8. The exact path of the burned fuel mixture through the engine will be later described. Within the engine, the fuel mixture expands to supply the engine power and results in spent, hot exhaust gas which is discharged through a pipe 19 to the heat exchanger 13, particularly through a heat exchange element 21 therein in thermal exchange relationship with the exchange surface 14. Thus, heat from the exhaust gas in the element 21 is transferred to the relatively colder incoming compressed air in the element 14. The cooled exhaust gas after such heat exchange is released to the atmosphere through an outlet pipe 22.

Figure 2:
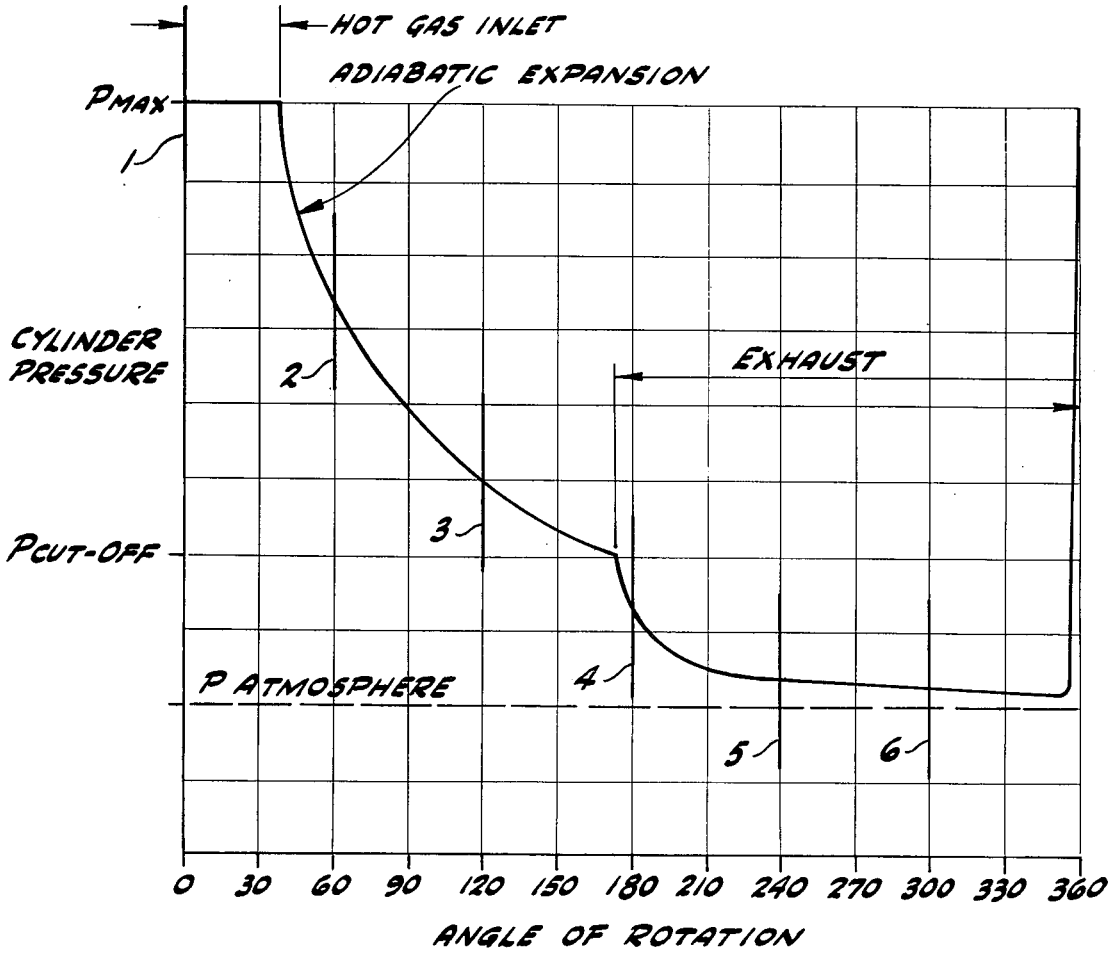
FIG. 2 is a diagram disclosing the relationship of the cylinder pressure and piston position in a typical cylinder of the engine during one complete cycle.

The work cycle in the engine of the gases following such a path as illustrated in FIG. 2, in which the abscissae are representative of one rotation of the shaft 6 in the engine 8 and the ordinates are pressures within an engine cylinder. The chart starts at a maximum pressure in the upper left-hand corner at a minimum volume, piston dead-center position of the shaft 6, then indicates some engine motion, during which uniformly high pressure, hot gas from the line 18 is introduced into the engine cylinder. The hot gas admission is cut off at a chosen point (in this instance, at about 40 degrees of shaft rotation of the engine), and the cut-off or isolated hot gas then expands adiabatically in the cylinder from the initial high pressure down to an intermediate exhaust pressure near the opposite dead-center or 180 degree point. Just before opposite dead center, the exhaust port is uncovered and the pressure of the cylinder-contained gas immediately drops on another curve until its pressure is slightly above that of the atmosphere. The exhaust port is open for a long enough time so that when the exhaust of the cylinder gas is terminated by covering of the exhaust port and when whatever remaining gas trapped in the cylinder is subsequently compressed, the pressure thereof rises to a value substantially that at the beginning of the cycle.

Figure 3:
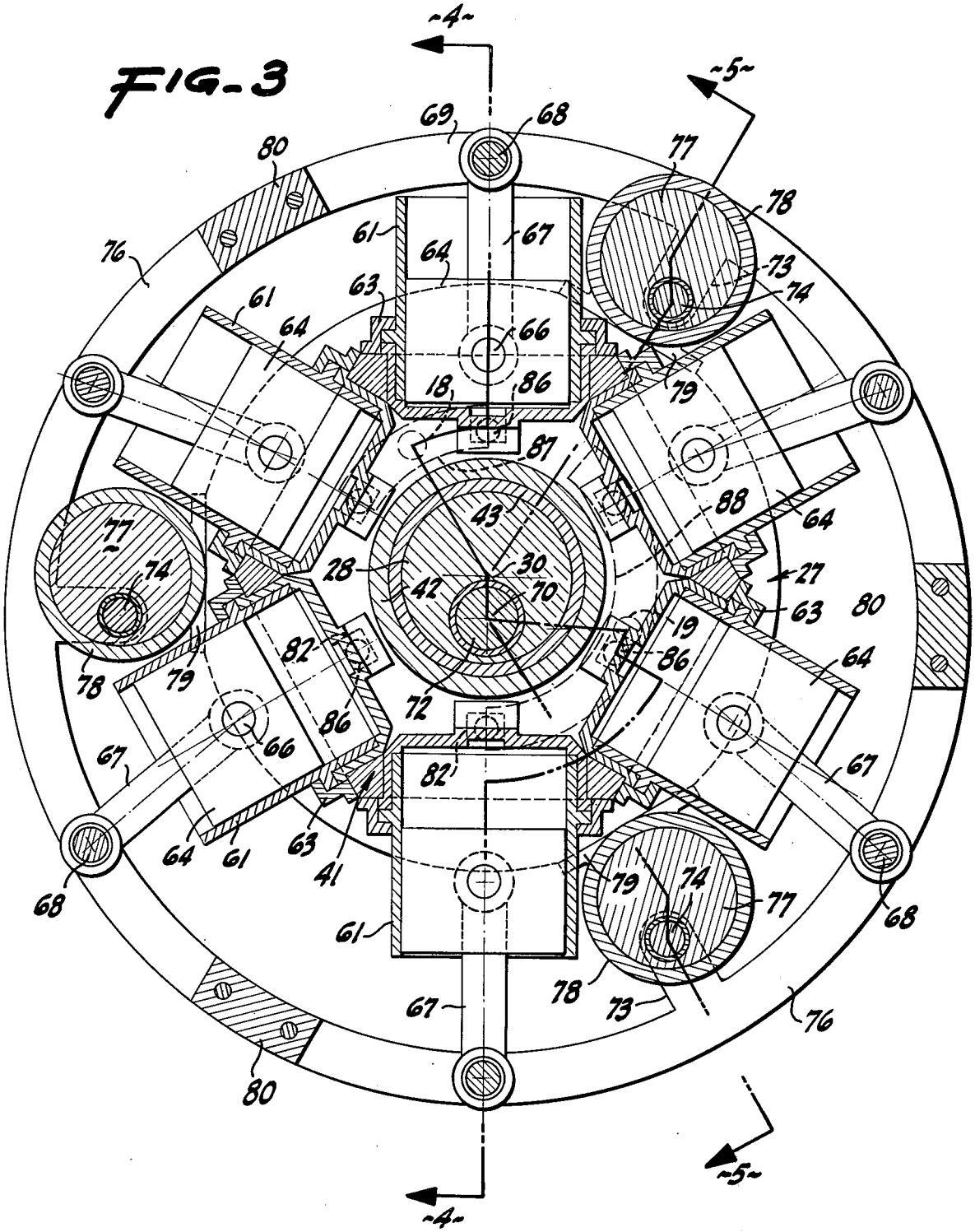
FIG. 3 is a cross-section in a plane perpendicular to the axis of rotation of the engine and through the axes of the cylinders showing the general arrangement of the engine.

As particularly shown in FIGS. 3 and 4, the engine 8 is greatly simplified for clarity, an enclosure, various fastenings and the like being omitted. The engine includes a base 26 (FIG. 4) of any convenient kind and here illustrated simply as a stationary supporting member. To the base is secured a spool 27 having a hub portion 28 integral with one fixed side plate 29 having parallel surfaces 31 and 32 extending normally to the axis 30 of the hub 28. There is also a spool side plate 33 fixed on the other end of the hub 28 and having an outside surface 34 and an inside surface 36 extending normally to the hub axis 30.

Designed to operate around the spool 27 is a cylinder rotor 41 inclusive of a second hub 42 on a bearing 43 concentric with the axis 30 of the spool 27. The rotor hub 42 is inclusive of a side disc 44 extending substantially normal to the axis 30 and having a side face 45 opposite the face 32 and having a side face 46 remote therefrom. Between the faces 32 and 45 there is an annular clearance volume 47. Similarly, the rotor hub 42 also carries a side disc 48 having a side face 49 and a side face 51 both extending normally to the axis 30. The faces 51 and 36 are spaced apart axially to define a clearance volume 52 comparable to the clearance volume 47, both clearances being axially variable as the spool and hub shift slightly in an axial direction with respect to each other, although the sum of the two clearances 47 and 52 is always substantially a constant.

The exterior of the hub 42 is substantially hexagonal in end aspect and, in this case, has six flats on each of which there is fastened an outwardly opening, two-part cylinder 61 of the single-acting variety. There are flanges 62 for holding the two cylinder parts on the hub by means of a fastening ring 63.

Each of the cylinders is provided with a reciprocating piston 64 of the usual sort movable from a position adjacent the head of the cylinder to another position adjacent the end of the skirt thereof. Each of the pistons has a piston pin 66 at one end of a connecting rod 67. At the other end, the rod 67 is joined by a fastening pin 68 to the rim 69 (FIG. 4) of a rotor 71 having a generally bell-like configuration. The rotor is keyed to a driven shaft 72 having an axis 70 parallel to and spaced from the axis 30. The shaft 72 is appropriately connected in any standard way, not shown, and extends through a bushing 75 in the stationary spool 27. The shaft 72 is the power output shaft as it revolves relative to the base 26 and is the equivalent of the shaft 6 of FIG. 1.

Figure 5:
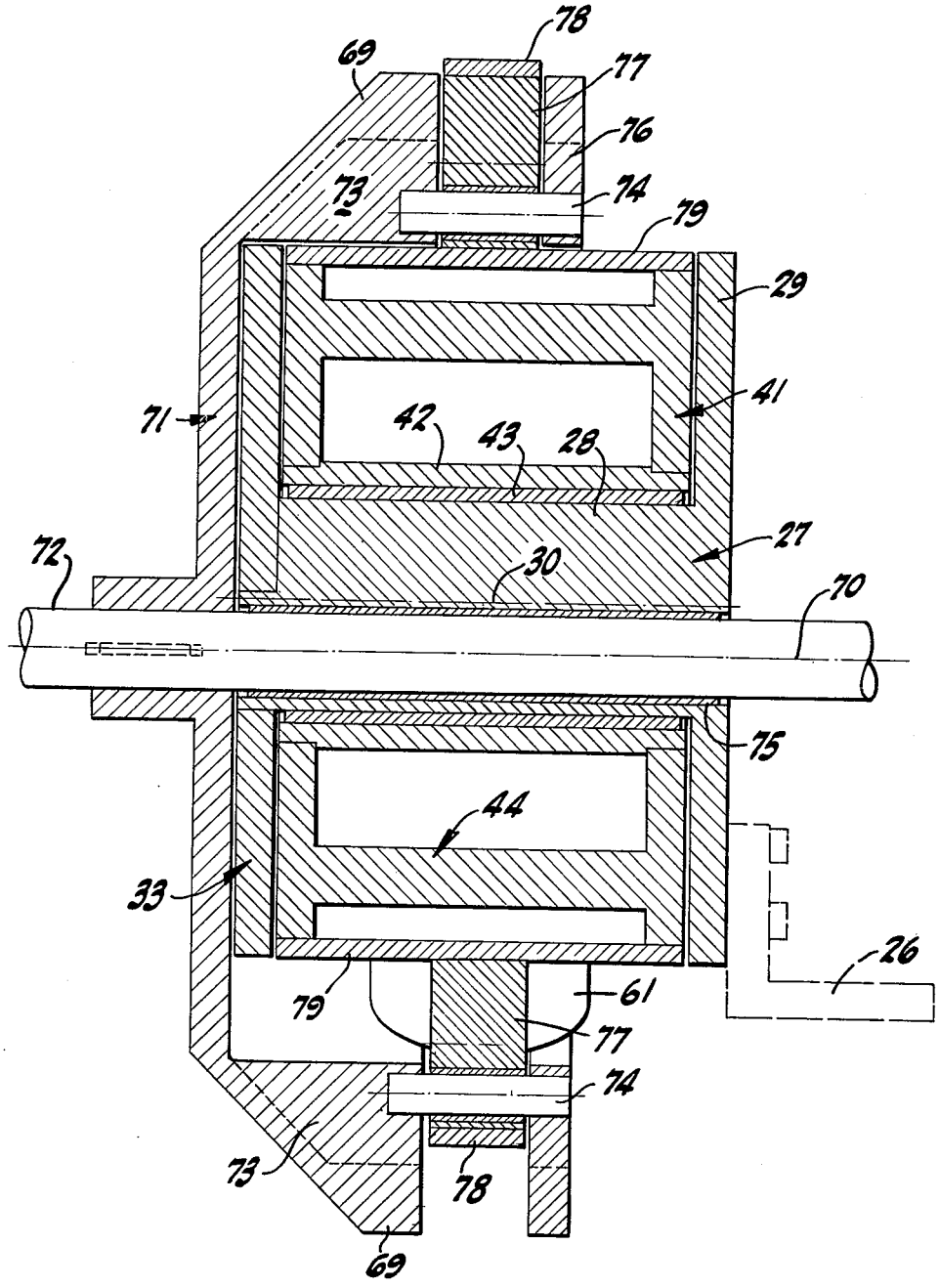
FIG. 5 is a cross-section, the planes of which are indicated by the lines 5—5 of FIG. 3.

Properly to interrelate the rotor 71 and some remaining mechanism, particularly the spool 27, the rotor 71 adjacent the rim thereof has inwardly extending lugs 73 (FIG. 3), there being three of the lugs equally spaced around the periphery of the rotor. Each of the lugs carries an axial pivot pin 74 (FIG. 5) at one end extending into the rim 69 of the rotor 71 and at the other end extending into a ring 76 secured by fasteners to projections 80 on the rotor rim 69. Mounted on each of the pins 74 is an eccentric disc 77 (FIG. 3), each disc having an eccentric radius equal to the radial distance between the axes 30 and 70. The discs are encompassed by eccentric strap bearings 78, each of which has a pad 79 thereon firmly mounted on the exterior of the cylinder rotor 41.

With this arrangement, as the mechanism operates, there is rotation of a bi-axial character, so that the pistons 64 reciprocate within their individual cylinders 61, thus effecting certain input and exhaust functions, and likewise transmitting power from the pistons to the driven shaft 72.

In order that the propulsive or pressure fluid be properly supplied to the individual cylinders to be effective upon the individual pistons 64, each of the cylinders in its head 81 is provided with a clearance volume 82 (FIGS. 4 and 10) leading axially to an opening 83 designed to communicate with a thermal tube 84 having a port 86 at its end coplanar with the planar surface 45 bounding the clearance 47 on one side.

The thermal tube 84 is shown in more detail in FIG. 12. Mating flanges 201 and 202 on the head 81 and the tube 84 are secured together in the usual way, but to reduce heat transmission, the flange 202 merges through a thin wall with a thin tubular wall 203. A branch, thin wall 204 extends, separate from the wall 203, from the flange 202 to an anchoring flange 206 having appropriate fastening to the side disc 44. Not only is heat flow substantially reduced by the thin wall section, but some extra flexibility is derived so that the adjacent parts readily accommodate each other despite temperature changes.

Figure 8:
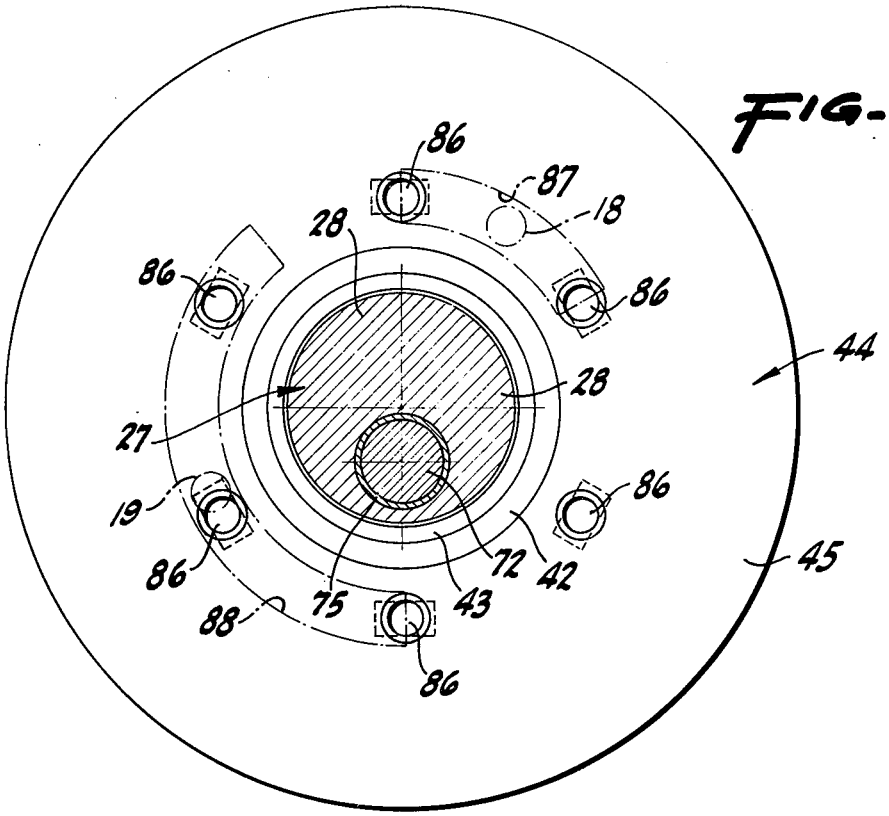
FIG. 8 is a diagram showing pressure air ports at the side of the engine.

To cooperate with the tube 84 and the port 86, there is provided in the fixed plate 29 an arcuate inlet port 87 (FIGS. 8 and 9) in certain positions of the rotor registering successively with the rotating ports 86. The port 87 has a peripheral extent corresponding to the desired input timing of the mechanism. This is to admit pressure fluid to the adjacent clearance volume 82, substantially as illustrated in the diagram of FIG. 2 and as shown in FIG. 8, from approximately inner dead center to a predetermined position of the ports after inner dead center. The arcuate input port 87 is connected to the pressure pipe 18 somewhat circuitously to inhibit heat flow. Similarly, the ports 86 (FIG. 8) also cooperate with an almost semi-circular, or arcuate, exhaust port 88 (FIG. 9) in the plate 29 open to the return pipe 19 in a standard way. The duration of the exhaust cycle is substantially as indicated in FIG. 2.

Since much of the proper operation of the engine, particularly over long periods, depends upon the clearances 47 and 52, especial means are provided to ensure that the walls of the clearance spaces are properly spaced and operate in substantial parallelism. The inlet gas under pressure exerts an off-center axial force on the rotor and tends to tilt the rotor as it revolves. Any substantial amount of such tilting renders the clearance spaces non-parallel. For this reason, and as shown in FIG. 6 as one example, the engine is arranged for an unusual handling of lubricating oil under pressure.

There is a common drive shaft 91 which may easily be coupled to an appropriate power source. The drive shaft 91 is connected to two lubricating oil pumps 92 and 93. Each pump is a constant flow or constant volume pump and receives oil from a sump such as the engine crankcase. Each pump supplies a predetermined flow of lubricating oil under pressure through separate supply pipes 94 and 96. The pipe 94, for example, goes to a lubricating oil inlet port 97 in the side of the spool 27 and feeds oil to two outlets 98 and 99 across the spool axis and at diagonally opposite areas of the spool and discharging against the adjacent, diagonally opposite faces of the rotor hub 42. Similarly, the pipe 96 from the pump 93 feeds oil through the side of the spool to a pair of outlets 101 and 102 discharging against diagonally opposite areas of the spool and coplanar with the outlets 98 and 99, respectively.

Figure 6:
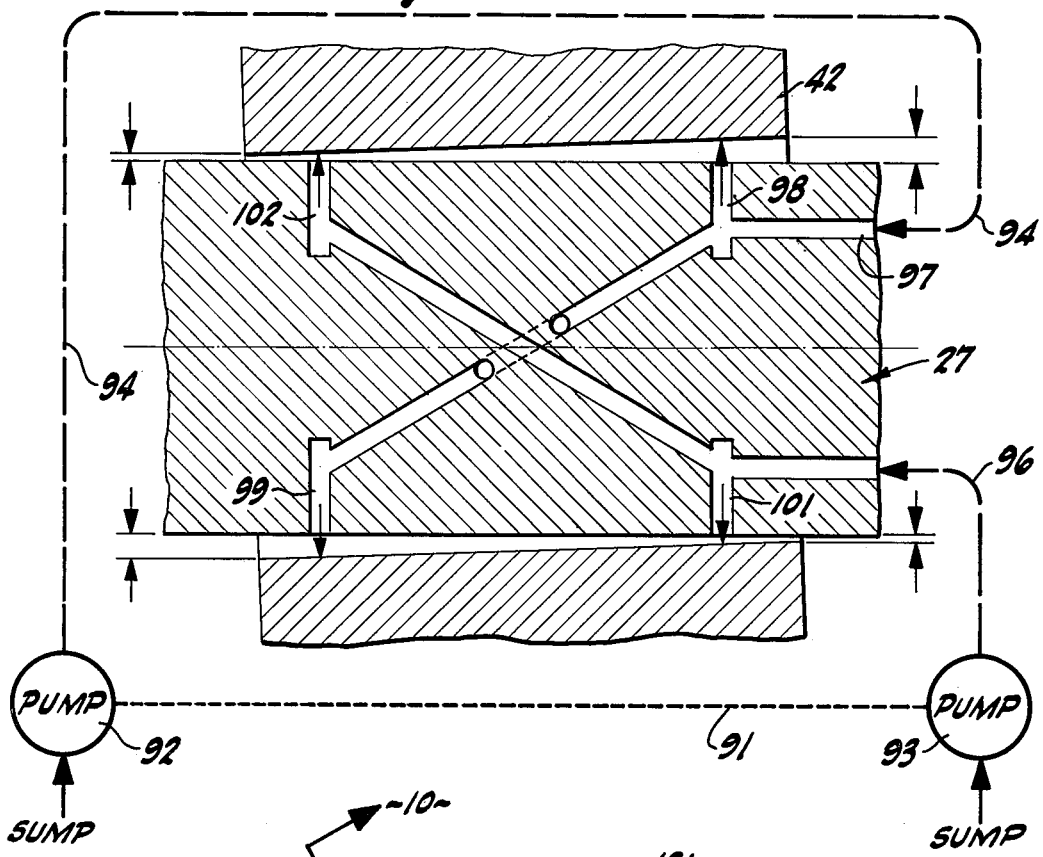
FIG. 6 is a diagram disclosing part of the engine as seen in FIG. 4 and with certain oil pressure arrangements.

In this way, should the relatively rotating parts 27 and 42 cant or cock, as shown in exaggerated form in FIG. 6, the oil pressure at the resulting diagonally opposite, restricted outlets goes up, while the oil pressure at the diagonally opposite, unrestricted outlets goes down, thus supplying a force couple restoring the parts to coaxiality and parallelism. Return oil goes back to the sump for recirculation.

Other ways to maintain the desired clearances and parallelism despite disturbing forces are the arrangements illustrated in FIGS. 7, 8, 9 and 10. While these various figures show several variations, they also show many portions that are the same, and so employ the same reference numbers on comparable parts, although some accompanying items are different and so are differently designated.

Figure 7:
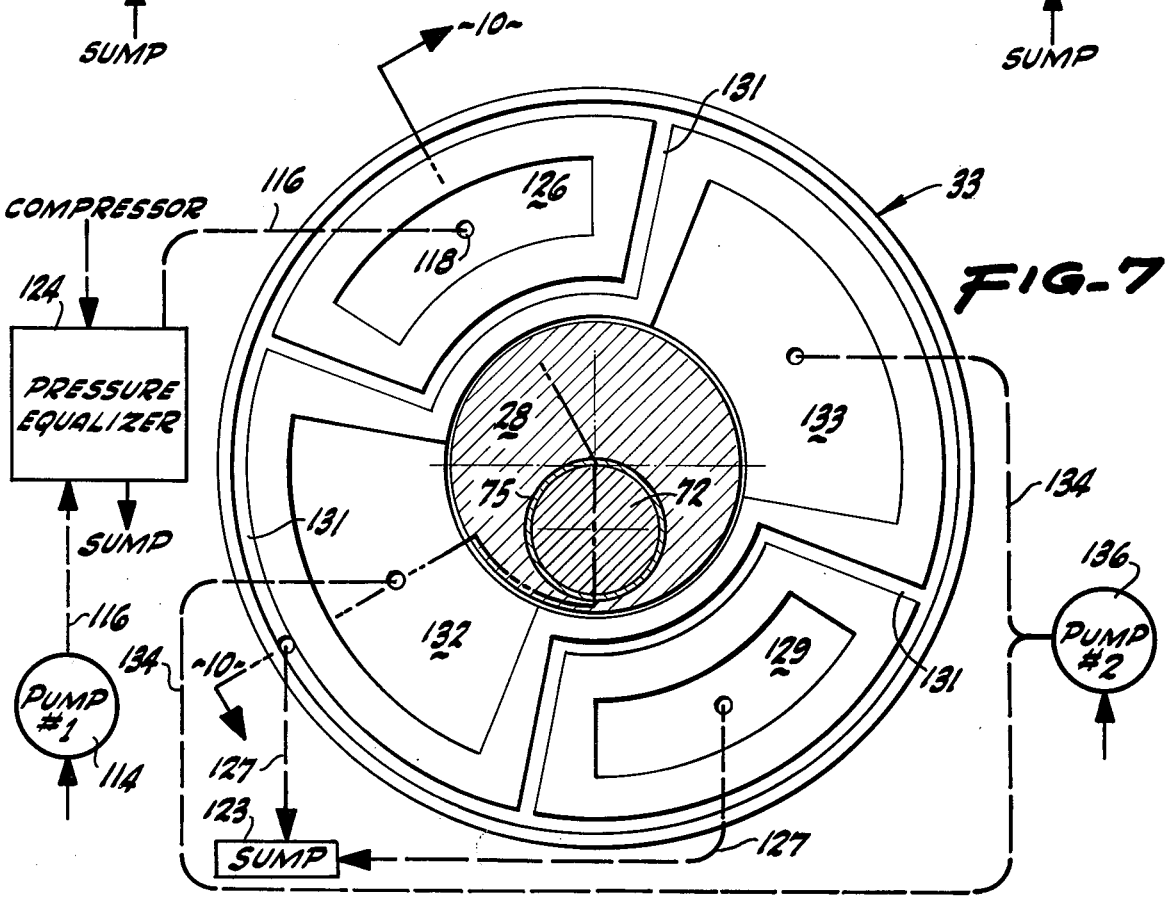
FIG. 7 is a diagram showing the relationship of certain oil pumps and inlet and outlet ports and the oil flow paths therebetween.

As particularly illustrated in FIG. 7, there is a first force pump 114 operated by a drive (not shown) and effective to supply a constant output volume through a line 116 to a pressure equalizer 124. This equalizer, like the equalizer 157 shown in FIG. 11, responds to air pressure from the compressor 7 (FIG. 1) and releases oil (or comparable lubricant) to a sump like the sump 152 of FIG. 11. From the equalizer 124, pressure oil flows through the line 116 and an entry 118 to an arcuate recess 126 in the spool side plate 33. This is substantially opposite to and is comparable in area with the air inlet port 87 on the other side of the engine. The oil force due to the recess thus tends to counterbalance the force due to the pressure air in the inlet port 87 on the other side of the engine.

Another force pump 136, comparable to the pump 114, and conveniently sharing the drive thereof, is effective to afford a constant oil output to a line 134 open to an arcuate recess 132 in the side plate 33 and also open to diametrically opposite arcuate recesses 132 and 133 in the side plate 33. Thus pressure oil is distributed to these equal areas. Oil flowing from the various recesses and across the surrounding planar surfaces is received in channels 131 or drain grooves connected through a return line 127 to the sump 123. An arcuate recess 129 is opposite the exhaust port 88 and diametrically symmetrical with the arcuate recess 126 and is also connected to the sump 123 by the return line 127. This construction has as one function the control of the axial gap dimensions. This arrangement is effective to provide compensating or balancing forces by oil pressure to oppose or offset forces due to incoming gas and exhaust gas forces.

Figure 9:
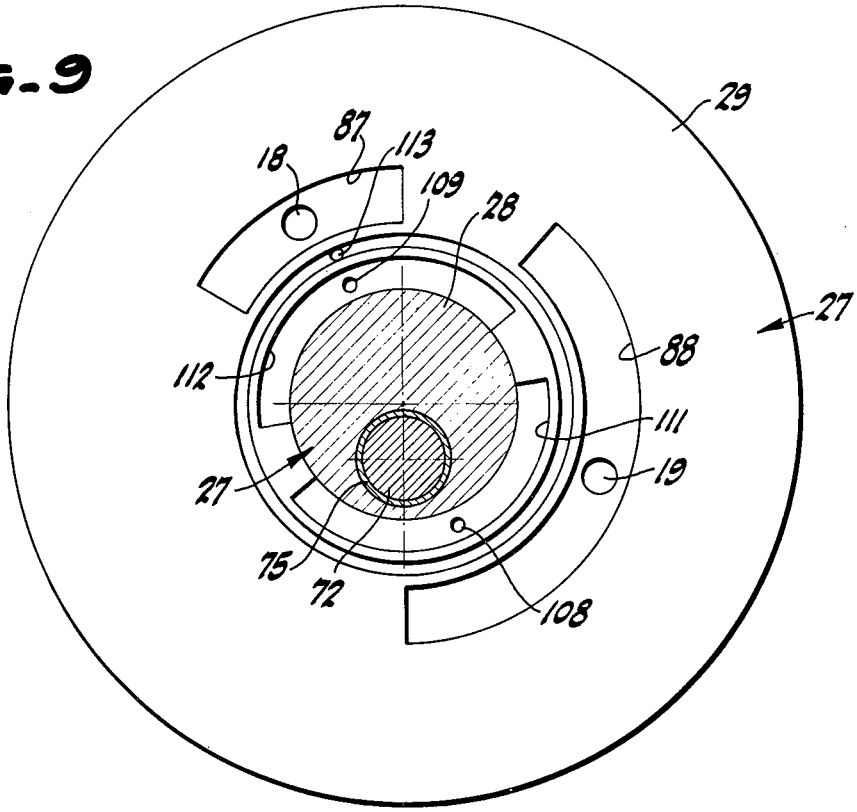
FIG. 9 is a diagram showing pressure oil ports at the side of the engine.
Figure 10:
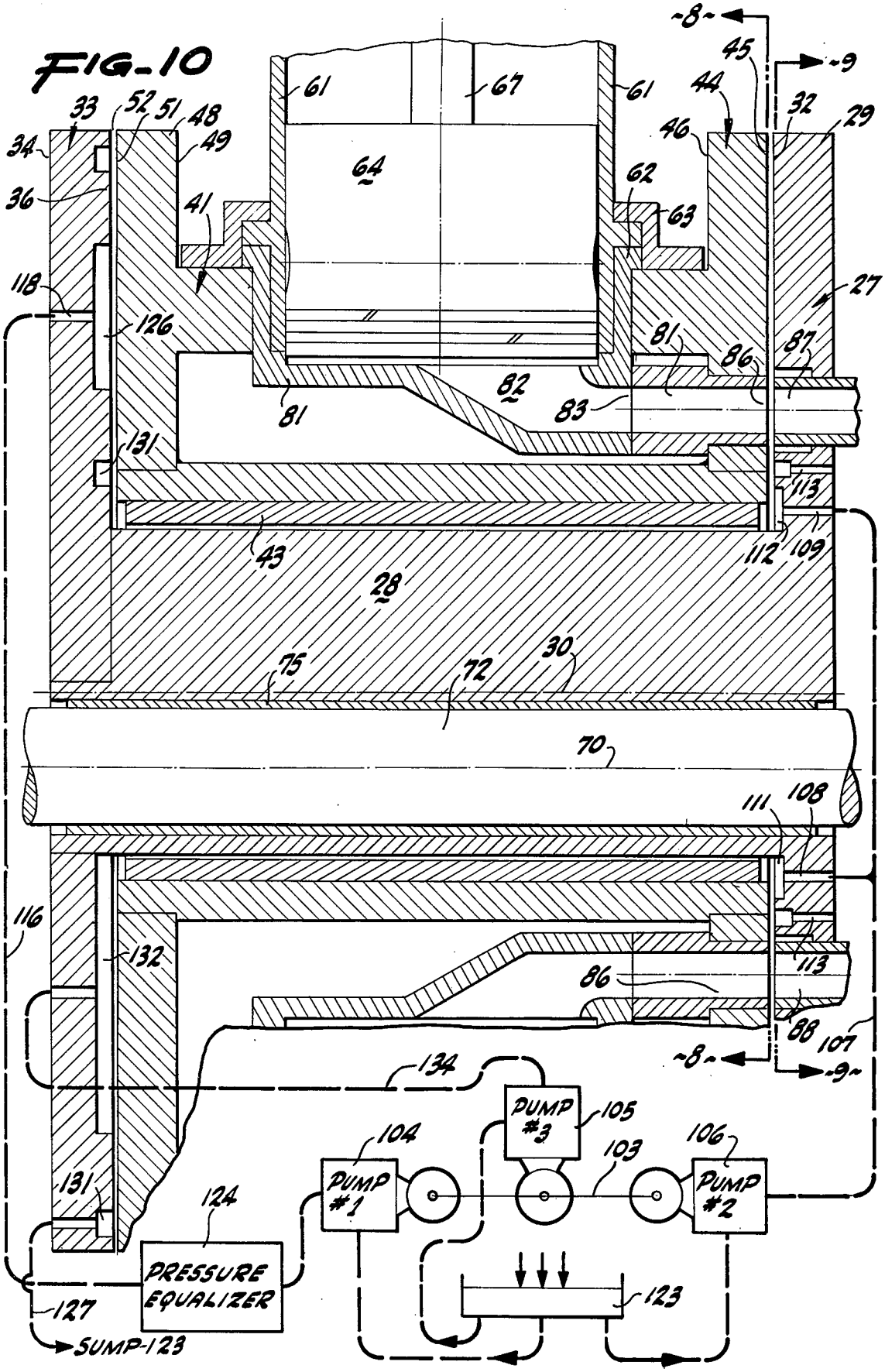
FIG. 10 is a diagrammatic cross-section through the main shaft and the adjacent portions of the rotor showing air passages and oil passages and connections for a special form of clearance compensating arrangement.

In a related way to maintain the desired clearances and positions despite disturbing forces, the arrangement especially illustrated in FIGS. 9 and 10 may be employed. A drive shaft 103 (FIG. 10) operates a number of constant volume pumps 104, 105 and 106. The pump 106 takes from a sump 123 and discharges into a line 107 and so supplies oil under pressure through ports 108 and 109 to oil recesses 111 and 112 in the side plate 29 (see FIG. 9). The effect is to separate the rotor disc 44 and the plate 29 by a film of lubricant. Return flow is through outlets 113 having connections (not shown) to the oil sump 123. The oil supply to the side plate 29 is thus effective to lubricate and assist in positioning the side disc 44.

The left-hand side disc 48 is somewhat similarly lubricated and positioned by arrangements in the side plate 33. The oil pump 104, like the oil pump 106, takes from the sump 123 and discharges through a pressure equalizer 124 and a line 116 to an entry 118 in the side plate 33 opening into an arcuate recess 126 in that plate and generally opposite the high pressure arcuate inlet port 87 (see also FIGS. 8 and 9). The recess 126 is open to the clearance 52. Return grooves 131 (FIG. 10) connect to the sump 123. The third pump 105 driven by the shaft 103 also takes from the sump 123 and discharges into a pressure line 134 opening into the recess 132 similar to the arrangement of FIG. 7, but since, in this instance, there is a separate supply pump, the effect is comparable to that of the arrangement of FIG. 6. The pumps 105 and 106 tend to keep the side plates and the side discs parallel as well as evenly spaced with the desired narrow gaps between them. The pump 104 and the pressure equalizer 124 counteract the force and moment created by the inlet duct 87. By eliminating tilt, the gaps tend to remain uniform.

Figure 11:
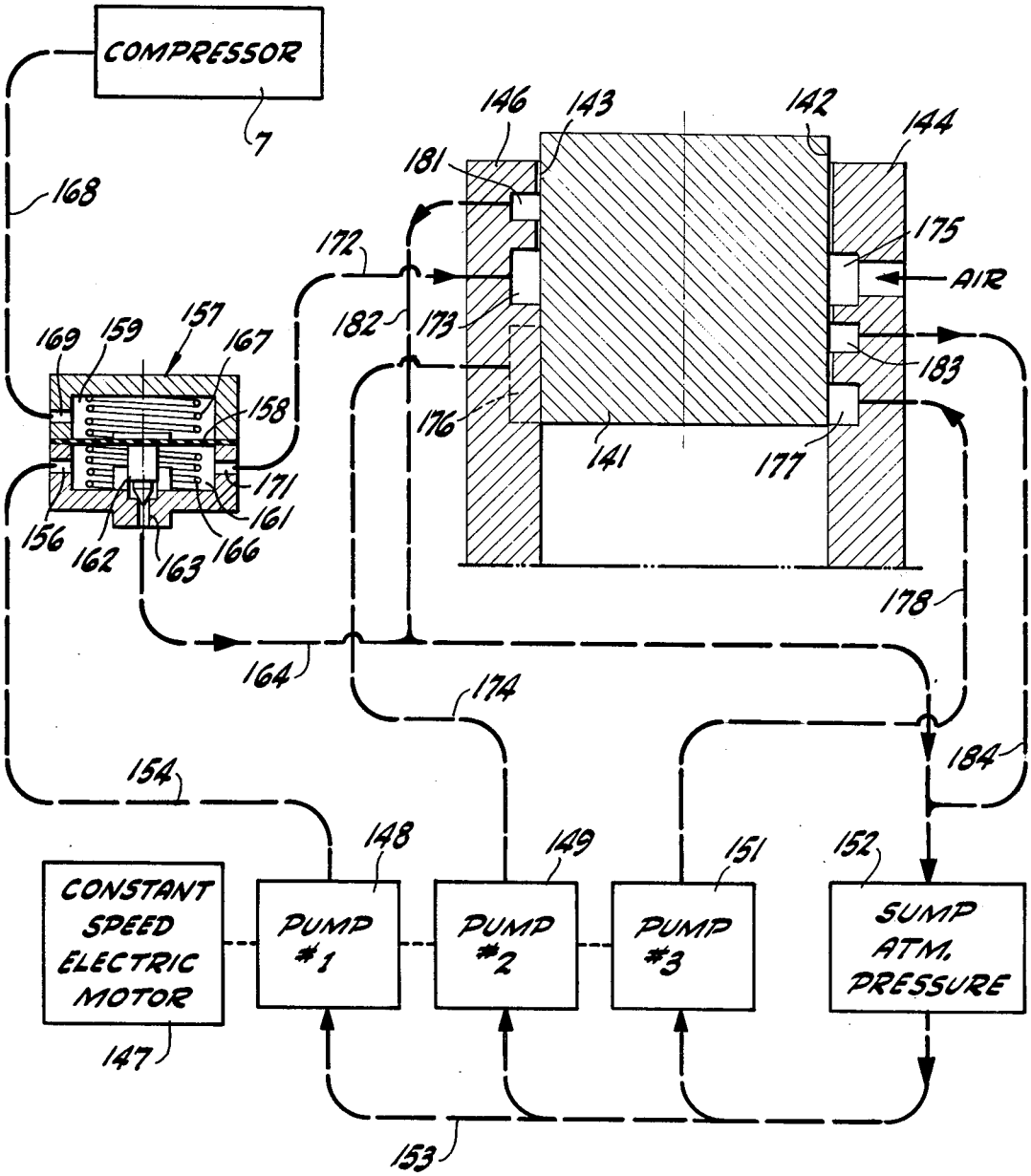
FIG. 11 is a diagram showing another clearance compensating arrangement.

As a further variation of means for arranging proper clearance volumes and positions between the side plates and side discs, the arrangement of FIG. 11 is effective. This also takes into account variations in the pressure of the driving gas. As shown diagrammatically, the engine pistons reciprocate in cylinders in a cylinder rotor 141 comparable to the rotor 41. The rotor 141 has side walls 142 and 143 spaced from side plates 144 and 146 like the rotor 41 and side plates 29 and 33. A constant speed electric motor 147 or comparable driver operates three constant flow pumps 148, 149 and 151 simultaneously.

The pump 148 receives lubricating oil from a sump 152 at atmospheric pressure through a manifold 153 and discharges the oil at increased pressure through a line 154 to a port 156 in a pressure regulator 157. This is an enclosure divided by a pressure diaphragm 158 into an upper chamber 159 and a lower chamber 161. A valve pin 162 joined to the diaphragm controls the opening and closure of a drain port 163 connected through a drain line 164 to the sump 152. A lower spring 166 tends to urge the valve pin 162 in the port opening direction. But the valve pin is urged in the opposite direction, toward port closure, by an upper spring 167 that preferably is adjustable as to the force exerted to vary the effective pressure ratios. More particularly, the diaphragm 158 is also urged toward port closed position by pressure within the upper chamber 159 derived from the air compressor 7 (FIG. 1) and exerted through a line 168 opening into the upper chamber 159 through a port 169.

With this arrangement, the oil pressure in the lower chamber 161 is made to follow, at any desired and adjustable ratio, the air pressure at the compressor 7. That is, when the compressor pressure drops, the diaphragm 158 bows upwardly and opens the port 163, thus lowering the pressure in the lower chamber 161 correspondingly. Comparably, when the compressor air pressure rises, the diaphragm 158 is urged downwardly to close the port 163, so as the pressure in the chamber 161 varies, the outlet pressure of the pump 148 is closely and comparably changed.

The oil from the lower chamber 161 is conducted through a port 171 and a line 172 to a recess 173 in the side plate 146 opposite to the air pressure inlet port 175 corresponding to the port 87 (FIG. 10). Since the recess 173 and the ports 175 or 87 are comparable in position opposite each other and in area, this arrangement provides a variable counteracting or balancing force on one side of the cylinder block or rotor 41 substantially cancelling the force due to the variable pressure air against the other side of the cylinder block or rotor, and so maintains the desired spacing and eliminates tilt and unbalance and wear for this reason.

The second pump 149 receives oil from the manifold 153 and is connected by a duct 174 to a recess 176 in the plate 146 substantially opposite a similar recess 177 in the plate 144. A duct 178 joins the recess 177 to the third pump 151 supplied with oil like the pumps 148 and 149. This arrangement provides substantially equal and opposite oil pressure forces tending in themselves to centralize and maintain proper clearances between the cylinder rotor 141 and the side plates 144 and 146.

Leakage oil is caught, for example, in a recess 181 in the plate 146 and is returned through a pipe 182 to the drain line 164 and so goes back to the sump 152. Leakage oil is also caught in a recess 183 joined by a line 184 delivering through the line 164 to the sump 152. As disclosed herein, there are provided means for establishing balancing forces for keeping the rotating parts properly centralized and oriented and also for furnishing a variable force offsetting the variable force on the rotor from the incoming pressure air.

In the general operation of the engine, while the spool 27 remains stationary with respect to the mounting 26, the various cylinders and pistons rotate with the rotor 71 about the cylinder axis 30 and the rotor axis 70. During this time, the pistons 64 through their connecting rods 67, connected to the rotor 71, reciprocate in the cylinders. The pistons are impelled by gas under pressure entering the cylinders 61 from the pipe 18 and the port 87 and the tube 84 extending into the cylinder. The returning pistons expel the expanded gas through the ports 86 and the port 88 leading into the pipe 19. In this way, the cylinders 61 rotate relative to the spool 27, and the pistons both rotate about an axis and reciprocate in the cylinders, thus acting through the rotor 71 to rotate the shaft 72 with respect to the stationary spool 27 and so affording power.

While the displacement mechanism shown and described herein is in the form of an engine, and has been so designated, it can equally well be embodied as a compressor, as will be appreciated by those skilled in the art.

I claim:

1. An engine comprising a base, a spool mounted on said base and including a first hub symmetrical about a first axis and including a pair of side plates normal to and having inside faces spaced apart along said first axis, means defining plate ports in said inside faces, a cylinder rotor including a second hub rotatable on said first hub about said first axis and including a pair of side discs normal to and having outside faces spaced apart along said first axis between said side plates to establish first and second axial clearances each between one of said side plates and the adjacent side disc, cylinders mounted radially on said rotor, means establishing ducts in said cylinders extending to disc ports in said outside faces generally axially opposite said plate ports, a driven shaft eccentrically journalled with respect to said hub, a rotor fast on said driven shaft, pistons in said cylinders, and means for operably connecting said pistons to said rotor.

2. A device as in claim 1 including pivot pins on said rotor and in which said means for connecting said pistons to said rotor includes connecting rods pivoted to said pistons and to said pivot pins, eccentric discs on said rotor, eccentric strap bearings on said eccentric discs and secured to said spool.

3. A device as in claim 1 including means for supplying fluid under pressure to one of said axial clearances, and separate means for supplying fluid under pressure to the other of said axial clearances.

4. A device as in claim 3 in which said fluid is lubricating oil.

5. A device as in claim 3 in which said supplying means supply oil at constant volume.

6. A device as in claim 3 in which both of said oil supplying means are driven in unison.

7. A device as in claim 1 including a low-pressure sump, and means forming drain passages from said axial clearances to said sump.

8. A device as in claim 1 in which said axial clearances are of predetermined total axial dimensions to limit the leakage therethrough to the atmosphere from said plate ports and said disc ports.

9. A device as in claim 1 including means for supplying oil under pressure to both of said axial clearances near one of the radial ends thereof, and means for releasing oil under pressure from both of said axial clearances near the opposite radial ends thereof.

10. An engine comprising a stator hub having an axis, a pair of stator side plates disposed on said hub and having surfaces axially spaced apart and extending normal to said axis, a rotor journalled on said hub and including a pair of side discs disposed between and having surfaces adjacent said side plates defining therebetween a first clearance volume and a second clearance volume, a first pump, means for operating said first pump for discharging a first predetermined quantity of lubricating fluid into said first clearance volume, a second pump, and means for operating said second pump for discharging a second predetermined quantity of lubricating fluid into said second clearance volume.

11. An engine as in claim 10 in which said first and said second predetermined quantities are the same.

12. An engine as in claim 10 in which said first pump and said second pump are substantially of equal displacement and are operated at substantially the same speed.

13. An engine comprising a stator including a pair of oppositely disposed and axially spaced side plates and a hub extending between said side plates; a rotor journalled on said hub and including a pair of side discs between and respectively adjacent to said side plates; means defining a first pressure port in one of said side plates directed toward the adjacent one of said side discs; means for supplying a stream of pressure fluid to discharge through said first pressure port toward said one of said side discs; means defining a second pressure port in the other of said side plates directed toward the other of said side discs adjacent thereto and substantially opposite said first pressure port; and means for supplying a stream of pressure fluid to said second pressure port to discharge through said second pressure port at a pressure, location and over an area to counterbalance the effect of said stream of pressure fluid.

14. An engine as in claim 13 in which the shape and area of said first pressure port and the supply of pressure fluid therethrough and the shape and area of said second pressure port and the supply of pressure fluid therethrough maintain said side discs and said side plates axially spaced substantially predetermined distances from each other.

15. An engine comprising a stator hub symmetrical with and extending along an axis, a pair of stator side plates on said stator substantially normal to said axis, a rotor hub surrounding said stator hub, a pair of rotor side discs on said rotor and respectively disposed adjacent to said side plates leaving clearance volumes therebetween, means defining first and second apertures diametrically opposite each other in the stator hub surface adjacent one of said clearance volumes, means defining third and fourth apertures diametrically opposite each other in the stator hub surface adjacent the other of said clearance volumes and in a common plane with said first and second apertures, means including a passage in said stator hub for supplying said first and fourth apertures with a quantity of lubricant under pressure, and means including another passage in said stator hub for supplying said second and fourth apertures with a similar quantity of lubricant under pressure.

16. An engine as in claim 10 including a third pump, means for operating said first pump, said second pump and said third pump to produce substantially equal outputs, a pressure regulator, means for conducting the output from said third pump through said pressure regulator to said first clearance volume, and means for controlling said pressure regulator in accordance with an operating characteristic of said engine.

17. An engine as in claim 16 including an intake air compressor, and means for using the pressure of intake air discharged by said compressor to said engine as said operating characteristic.

18. A device as in claim 3 in which said supplying means supply oil at a constant flow rate.

* * * * *